United States Patent [19]

Tanaka et al.

[11] Patent Number: 4,639,707

[45] Date of Patent: Jan. 27, 1987

[54] TRANSFORMER WITH TOROIDAL MAGNETIC CORE

[75] Inventors: Kazuhiro Tanaka, Suita; Yasuo Yamamoto, Settsu; Katsumi Hanaoka, Kawanishi; Masatake Hirai, Kyoto, all of Japan

[73] Assignee: Allied Corporation, New York, N.Y.

[21] Appl. No.: 841,164

[22] Filed: Mar. 19, 1986

[30] Foreign Application Priority Data

Mar. 20, 1985 [JP] Japan ..... 60-39026[U]

[51] Int. Cl.[4] ..... H01F 27/30

[52] U.S. Cl. ..... 336/185; 336/198; 336/229

[58] Field of Search ..... 336/185, 196, 198, 208, 336/229, 207

[56] References Cited

U.S. PATENT DOCUMENTS

| | | | |
|---|---|---|---|
| 1,784,833 | 12/1930 | Hagemann | 336/198 X |
| 1,897,604 | 2/1933 | Clemons | 336/229 X |
| 2,216,863 | 10/1940 | Visman | 336/198 |
| 2,437,513 | 3/1948 | Gethmann | 336/229 X |
| 3,068,381 | 12/1962 | Vazquez | 336/229 X |

*Primary Examiner*—Thomas J. Kozma

*Attorney, Agent, or Firm*—Scully, Scott, Murphy & Presser

[57] ABSTRACT

A transformer with a toroidal magnetic core. The toroidal magnetic core is housed in an insulating case. The insulating case has a top and bottom annular winding frames. These frames provide radial winding conductor grooves. The top annular winding frame provides a plurality of grooves for guiding an inter-connecting conductor therein each of which is formed between two adjacent winding conductor grooves. The inter-connecting conductor is guided through said guiding groove to connect between the adjacent two unit coils.

4 Claims, 3 Drawing Figures

TRANSFORMER WITH TOROIDAL MAGNETIC CORE

FIELD OF THE INVENTION

The present invention relates to a transformer being comprised of a toroidal magnetic core and windings which are wound around the core.

BACKGROUND OF THE INVENTION

There has been proposed in the U.S. Pat. No. 4,524,342, a transformer with a toroidal magnetic core, as shown in FIG. 2, in which a plurality of high-voltage unit coils 3A are formed wound around winding frames or bobbins (not shown) respectively, which are arranged in a peripheral direction of the core spaced with each other and the winding end of each unit coil is connected to the beginning end of the adjacent unit coil with an interconnecting wire or the like to form a high-voltage winding 3.

The toroidal magnetic core 1 is formed by a strip material of an amorphous alloy metal, which is wound up so as to have a thickness designated. The core is kept in an insulator case 2.

On the other hand, as shown in FIG. 3, another type of transformer is also proposed prior to the present invention. In this case, the case 2 is comprised of four parts; an inner cylinder 2A and an outer cylinder 2B which are fitted to the inner and outer peripheral surfaces of the core 1, respectively, and an annular top winding frame 2C and an annular bottom winding frame 2D which cover the top and bottom surfaces of the core 1, respectively. This case 2 is provided for covering the core 1 in order to prevent it from distortion and to insulate it electrically against the winding.

On the top winding frame 2C and the bottom winding frame 2D mentioned above, a plurality of grooves 2*a* are provided radially for fitting the winding conductor therein. The unit coil 3A is wound around, inserted in each groove 2*a* partially. In this example, the unit coil 3A are electrically connected with each other in series to form a high-voltage winding 3.

Main insulators 4 for insulating a low-voltage winding against the high-voltage winding 3 are arranged so as to cover all the surfaces defined by the high-voltage winding 3 (In FIG. 2, there is shown only the main insulator attached to the top surface of the high-voltage winding 3). The low-voltage winding 5 is wound around the high-voltage winding 3 surrounded with the main insulator. In this example, the low-voltage winding 5 is double-layered. An insulator 6 between the layers insulate one against the other. Each one turn of the low-voltage winding 5, as shown in FIG. 2, is formed with four link-like conductors; the first conductor 5*a*, the second conductor 5*b*, the third conductor 5*c* and the fourth conductor 5*d*. The former two conductors 5*a l and 5b* are arranged in the radial direction of the toroidal core 1, along the top surface and the bottom surface of the core, respectively. The latter two conductors 5*c* and 5*d* extending in the axial direction of the core along the inside and outside thereof respectively, connect said first two conductors spirally to form one turn of the low-voltage winding.

In both types of transformers mentioned above, each unit coil 3A of the high-voltage winding 3 is formed with a strip-like conductor 3*a* coiled by the predetermined number of turns so as to be fitted or positioned in the winding bobbin (not shown in FIG. 2) or the winding conductor groove 2*a* provided on the winding frames 2C and 2D. In the case of FIG. 3, an inter-connecting conductor 3*c* is extended from the outer end of each unit coil at the outer side of the toroidal core, in order to connect one unit coil with the other adjacent one. Therefore, all the unit coils 3A are electrically connected in series.

In this case, as shown in FIG. 3, the strip-like inter-connecting conductor 3*c* which is an extension of the unit coil 3A if first folded so as to make right angle with the peripheral direction of the unit coil on the outer side of the unit coil. And this folded part 3*b* is fixed on the outer side surface of the unit coil 3A with a suitable adhesive tape. Subsequently, this inter-connecting conductor 3*c* is put over along the outer periphery of the insulating case to the next winding position of the unit coil as the connecting conductor. At this position, the inter-connecting conductor is again folded in the winding direction of the unit coil and the folded part 3*d* is fixed on the outer surface of the case 2 with a suitable adhesive tape. Then, the strip-like conductor 3*a* is wound around to form the next unit coil, fixed in the grooves 2*a* on the winding frames 2C and 2D, which are parts of the case 2.

As mentioned above, in the case that the inter-connecting conductor is formed by folding the outer end of unit coil, it is necessary to fold the strip-like conductor and to fix it by an adhesive tape. However, it takes a long time and is laborious. When the inter-connecting conductor is provided on the outer side of the core, as mentioned above, it is exposed bare. Due to this, the insulating structure of the outer surface of the core becomes very complicated.

SUMMARY OF THE INVENTION

An object of the present invention is to provide a transformer with a toroidal magnetic core, which solves problems of the prior arts mentioned above.

According to the present invention, there is provided a transformer with a toroidal magnetic core which comprises:

a toroidal magnetic core;

an annular winding frame for covering the top and bottom surfaces of the toroidal magnetic core in its axial direction thereof on which a plurality of grooves for inserting a winding conductor are formed radially;

at least one winding of the transformer being consisted of a plurality of unit coils being connected between the adjacent two of them electrically, where the unit coils are wound around the core, fixed in the groove of the annular winding frame;

conductor guiding grooves each being laid between two grooves for inserting a winding conductor adjacent to each other, said conductor guiding groove having a shallow groove portion near the end on the entrance side of the conductor guiding groove and a deep groove portion near the end on the exit side of the conductor guiding groove, the bottom of said deep groove portion is formed to have a plane same to that of the bottom of the winding conductor groove to which the exit end of the conductor guiding groove is connected.

BRIEF DESCRIPTION OF THE DRAWINGS

The present invention will now be described more in detail by way of examples and reference to the accompanying drawings in which.

DESCRIPTION OF THE PREFERRED EMBODIMENT

Figure 1:
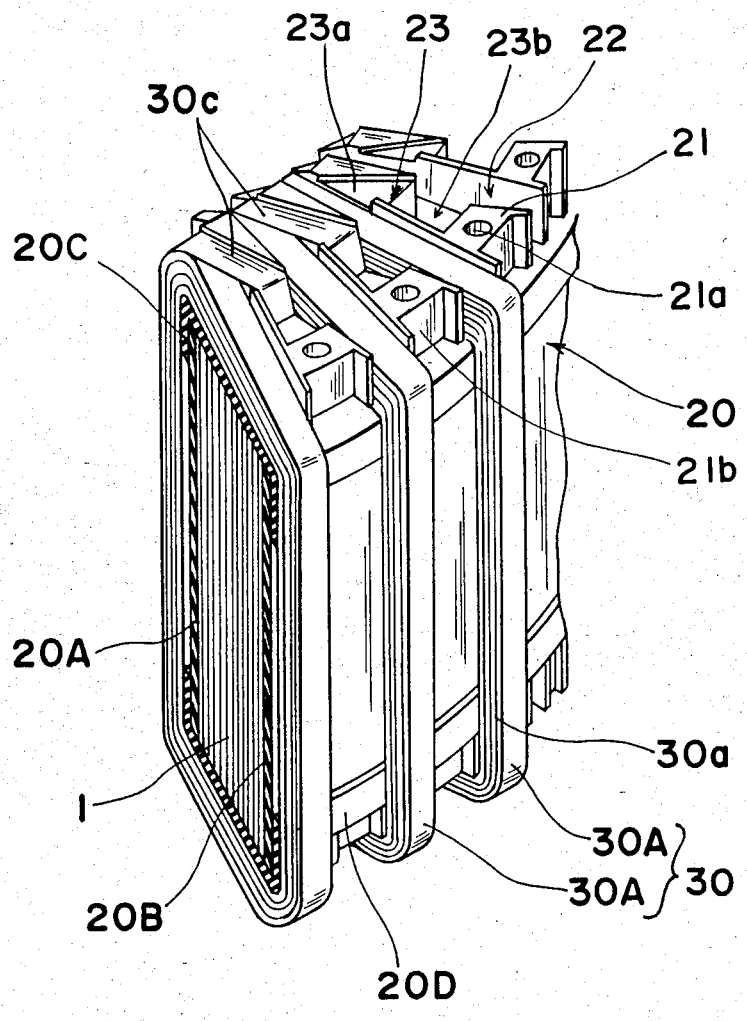
FIG. 1 is a perspective view partially broken away, showing a toroidal magnetic core with a high-voltage winding according to the present invention.

Referring to FIG. 1, a toroidal magnetic core 1 is formed of a strip material of an amorphous alloy metal which is wound up to have a thickness designated. The core is enclosed in an insulating case 20. The case 20 is comprised of four parts; an inner cylinder 20A and an outer cylinder 20B, which are fitted to the inner and outer cylindrical surfaces of the core, respectively, and an annular top winding frame 20C and an annular bottom winding frame 20D, having U-shaped sections respectively, which cover the top and the bottom surfaces of the core respectively.

As shown in FIG. 1, there are formed a plurality of radial thickenings 21 on the upper surface of the top winding frame 20C at a predetermined angular pitch. Between two adjacent thickenings 21 and 21, a groove 22 for inserting a winding conductor 30*a* is defined. Every groove thus defined has a depth slightly deeper than the thickness of a unit coil 30A for holding it therein entirely.

Further, each thickening 21 provides a guide groove 23 for inter-connecting two adjacent grooves 22 and 22 which runs inclined against the groove 22. The inlet portion of the guide groove 23 is connected to the inner end of each groove 22 for the unit coil.

The outlet portion of the guide groove 23 is connected to the outer end portion of the groove adjacent to the groove to which the inlet portion of said guide groove is connected.

The inlet portion of the guide groove 23 is formed on the upper surface of the thickening 21 as a shallow groove 23*a* having a depth slightly deeper than the thickness of the strip-like conductor and being positioned substantially as high as the outer periphery of the unit coil 30A. Contrary to the above, the outlet portion of the guide groove is formed as a groove 23*b* having a depth equal to that of the groove 22 for the unit coil 30A. In other words, the bottom surface of the groove 23*b* is continuous to that of the groove 22.

As shown in FIG. 1, it is desirable to provide recessions 21*a* and 21*b* in order to save the insulating material for the case and to reduce the weight of the case.

The bottom winding frame 20D has structures similar to those of the top winding frame 20C. However, the guide grooves 23 for inter-connecting conductors are not necessarily provided thereon.

The strip-like winding conductor 30*a* covered with an insulating coating material is wound around by the predetermined number of turns, fixed in the winding conductor groove 22 of the winding frames 20C and 20D, to form the unit coil 30A. The ending end of the unit coil 30A is put over to the adjacent winding conductor as follows:

Firstly, the conductor is bent at a slant so as to follow the conductor guiding groove 23 and is inserted in the shallow inlet portion 23*a* of the guiding groove 23 as an inter-connecting conductor 30*c*.

Secondly, the connecting conductor is bent down so as to come into contact with the bottom of the deep outlet portion 23*b*, and is fixed to the bottom of the said deep outlet portion 23*b* by a suitable means therefor.

Then, the said conductor out of the outlet of the deep groove portion 23*b* is guided to the bottom of the adjacent winding conductor groove 22, and is bent so as to follow the said winding conductor groove 22. On this instance, since there is substantially no difference in height between the exit of the deep groove 23 and the bottom of the winding conductor groove 22, it is easy to bent the conductor so as to follow the winding conductor groove 22. After the conductor is bent so as to follow the winding conductor groove 22, it is wound around, fixed in the said winding conductor groove 22 as the adjacent unit coil 30A.

To fix the connecting conductor in the deep outlet portion 23*b* of the conductor guiding groove 23, for example, a proper pushing-rod (not shown) can be provided in a winding machine. The pushing-rod presses down the connecting conductor 30*c* against the bottom of the said deep outlet portion 23*b* and fixes it therein, after said conductor is inserted in the conductor guiding groove 23.

Figure 2:
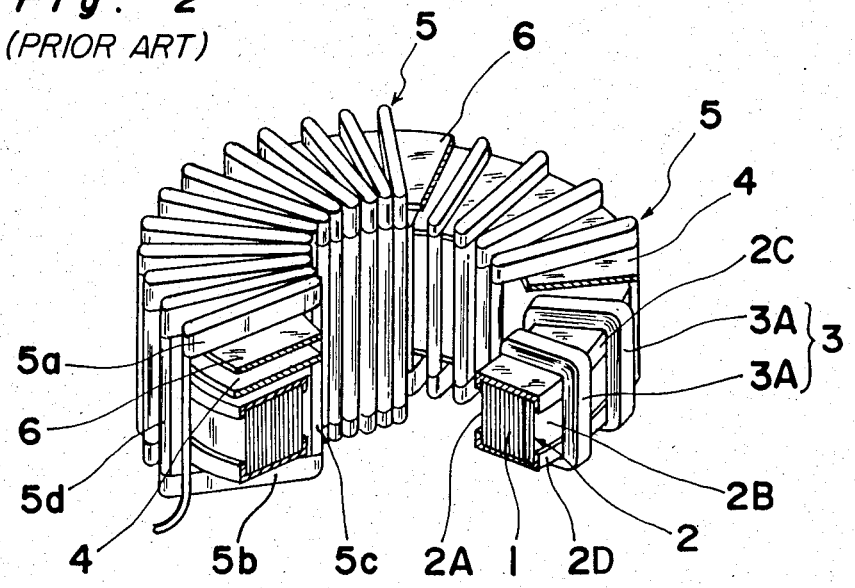
Fig. 2 (PRIOR ART)
FIG. 2 is a perspective view showing a conventional transformer.
Figure 3:
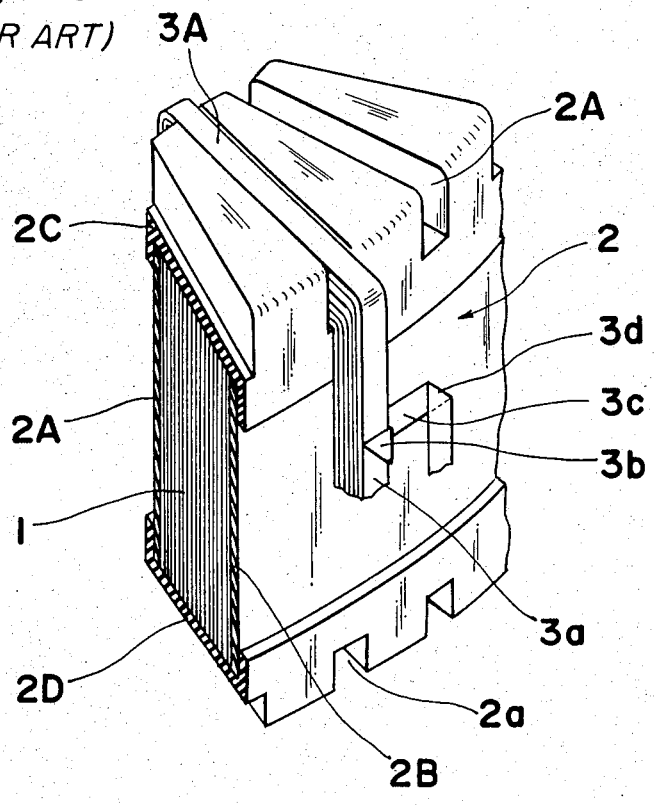
Fig. 3 (PRIOR ART)
FIG. 3 is a partially enlarged perspective view showing the winding frames used in the transformer shown in FIG. 2.

After the high-voltage winding 30 is formed by winding the unit coils 30A as mentioned above, a low-voltage winding is wound around so as to surround the said high-voltage winding. The low-voltage winding may be formed by a combination of many conductor links, as shown in FIG. 2. Or it may be formed by a suitable winding conductor which is wound around the winding frame, surrounding the high-voltage winding.

In the embodiment shown above, the unit coils 30A are continuously wound one by one and the adjacent two coils are inter-connected with each other by the inter-connecting conductor 30*c* being held in the conductor guiding groove 23. In this case, it is desirable that the inter-connecting conductor is pressed on the bottom of the deep groove portion 23*b*.

If the inter-connecting conductor guiding groove 23 is consisted of the shallow groove portion 23*a* and the deep groove portion 23*b* as mentioned above, and if the inter-connecting conductor is so bent down onto the bottom of the deep groove portion as to be guided along the bottom of the winding conductor guiding groove, the work of bending the inter-connecting conductor becomes easy because the inter-connecting conductor is bent merely by following said conductor guiding groove 23 so as to be guided into the adjacent winding conductor groove 22. As the inter-connecting conductor 30*c* is held in the conductor guiding groove, it becomes unnecessary to strengthen the insulating structures around the connecting portion, as a result, it becomes possible to simplify insulating structures.

Furthermore, according to the structures mentioned above, there is no inter-connecting conductor on the outer peripheral surface of the case 20. Therefore, the space defined between the adjacent two unit coils 30A and 30A can be utilized as the space for winding the low-voltage winding. In this case, the transformer can be made compact, since it becomes possible to reduce diametrical dimensions of the transformer.

In the embodiment mentioned above, the high-voltage winding is formed with the unit coils 30A wound around the insulating case 20. However, the present invention may be applied to a case that the unit coils forming the low-voltage winding are wound around the winding frames 20 mentioned above.

In the embodiment mentioned above, a strip-like conductor is wound up to a unit coil. However, as easily understood from the basic idea of the present invention, the present invention can be applied for winding the normal wire conductor having a circular section as a unit coil.

While there has been described the preferred embodiments, modifications and variations being obvious to those skilled in the art are possible without departing from the spirit of the invention. The scope is therefore to be determined solely by the appended claims.

What is claimed is:

1. A transformer with a toroidal magnetic core which comprises:

a toroidal magnetic core;

an annular winding frame for covering the top and bottom surfaces of the toroidal magnetic core in its axial direction thereof on which a plurality of grooves for inserting a winding conductor are formed radially;

a winding of the transformer being consisted of a plurality of unit coils being connected between the adjacent two of them electrically, where the unit coils are wound around the core, fixed in the groove of the annular winding frame;

conductor guiding grooves each being laid between two grooves for inserting a winding conductor adjacent to each other, said conductor guiding groove having a shallow groove portion near the end on the entrance side of the conductor guiding groove and a deep groove portion near the end on the exit side of the conductor guiding groove, the bottom of said deep groove portion is formed to have a plane same to that of the bottom of the winding conductor groove to which the exit end of the conductor guiding groove is connected.

2. A transformer with a toroidal magnetic core according to claim 1, wherein the bottom of the shallow portion is formed to have a height almost same to that of the outmost surface of the unit coil wound around the core being fixed in the winding conductor groove which is connected to the entrance end of the conductor guiding groove.

3. A transformer with a toroidal magnetic core according to claim 1, wherein said winding is a high-voltage winding being consisted with a plurality of unit coils connected in series.

4. A transformer with a toroidal magnetic core according to claim 1, wherein said winding is a low-voltage winding being consisted of unit coils connected in series.

* * * * *